US009006626B2

(12) United States Patent
Chang et al.

(10) Patent No.: US 9,006,626 B2
(45) Date of Patent: Apr. 14, 2015

(54) MULTI-SLOT MICROWAVE DEVICE AND PROCESSING SYSTEM THEREOF

(71) Applicants: Tsun-Hsu Chang, Hsinchu (TW); Tsung-Shune Chin, Hsinchu (TW); Hsien-Wen Chao, Hsinchu (TW); Shih-Chieh Fong, Hsinchu (TW)

(72) Inventors: Tsun-Hsu Chang, Hsinchu (TW); Tsung-Shune Chin, Hsinchu (TW); Hsien-Wen Chao, Hsinchu (TW); Shih-Chieh Fong, Hsinchu (TW)

(73) Assignee: National Tsing Hua University, Hsinchu (TW)

( * ) Notice: Subject to any disclaimer, the term of this patent is extended or adjusted under 35 U.S.C. 154(b) by 344 days.

(21) Appl. No.: 13/680,296

(22) Filed: Nov. 19, 2012

(65) Prior Publication Data

US 2013/0175261 A1 Jul. 11, 2013

(30) Foreign Application Priority Data

Jan. 10, 2012 (TW) ..... 101101007 A

(51) Int. Cl.

| | |
|---|---|
| ***H05B 6/64*** | (2006.01) |
| ***H05B 6/74*** | (2006.01) |
| ***H05B 6/76*** | (2006.01) |
| ***H05B 6/78*** | (2006.01) |
| ***H05B 6/70*** | (2006.01) |
| ***H05B 6/80*** | (2006.01) |

(52) U.S. Cl.

CPC .. *H05B 6/64* (2013.01); *H05B 6/74* (2013.01); *H05B 6/76* (2013.01); *H05B 6/78* (2013.01); *H05B 6/704* (2013.01); *H05B 6/80* (2013.01)

(58) Field of Classification Search

CPC ..... H05B 6/64; H05B 6/74; H05B 6/76; H05B 6/78

USPC ..... 219/679, 699, 748, 761; 333/134, 137, 333/202, 209, 210

See application file for complete search history.

(56) References Cited

U.S. PATENT DOCUMENTS

| | | | | |
|---|---|---|---|---|
| 3,263,052 | A * | 7/1966 | Jeppson et al. | 219/700 |
| 5,614,877 | A * | 3/1997 | Raghavan et al. | 333/227 |
| 6,020,579 | A * | 2/2000 | Lewis et al. | 219/696 |
| 6,066,290 | A | 5/2000 | Dennis et al. | |
| 2003/0209542 | A1 | 11/2003 | Harris | |
| 2012/0299667 | A1 * | 11/2012 | Hsu et al. | 333/202 |

* cited by examiner

*Primary Examiner* — Thien S Tran

(74) *Attorney, Agent, or Firm* — Muncy, Geissler, Olds & Lowe, P.C.

(57) ABSTRACT

A multi-slot resonant microwave device comprises a plurality of slot microwave resonator units and at least one microwave emitting source. Each of the plurality of slot microwave resonator unit is defined as a slot resonant cavity. Whenever at least one of the microwave emitting sources emits microwave power into the plurality of slot microwave resonator units, the plurality of slot microwave resonator units resonate simultaneously, and produce an electromagnetic field with the same polarization direction. Therefore, the multi-slot resonator device can deal with large-area microwave heating with greater microwave effect to shorten operating time and accomplish the objective of homogeneous and megathermal microwave heating.

22 Claims, 13 Drawing Sheets

MULTI-SLOT MICROWAVE DEVICE AND PROCESSING SYSTEM THEREOF

CROSS-REFERENCE TO RELATED APPLICATION

This application claims the benefit of Taiwan Patent Application No. 101101007, filed on Jan. 10, 2012, in the Taiwan Intellectual Property Office, the disclosure of which is incorporated herein in its entirety by reference.

BACKGROUND OF THE INVENTION

1. Field of the Invention

The present invention relates to a multi-slot microwave device and its processing system, and more particularly to a multi-slot microwave device and its processing system utilizing multi-slot resonator chamber to achieve large-area microwave heating.

2. Description of the Related Art

Microwave processing occupies a very important position during production and development processes such as drying process, chemical synthesis, carbonization process, high temperature thermal treatment, joining process or film thermal treatment and the like. With respect to a microwave processor, uniformly heating a sample at effective time and isolating heat and microwave effect in the microwave chamber are currently important and necessary issues.

U.S. Pat. No. 6,066,290 discloses microwave combining with a heating furnace to achieve large-area heating. The cited reference uses waveguide to connect a chamber and a microwave source. Since the waveguide is a cone, the energy of the microwave source can be transmitted to a material to be microwaved in a chamber through a manner of enlarging areas so as to further achieve a purpose of saving energy. It easily causes non-uniform heating for the material to be microwaved although the manner increases the productivity.

U.S. published number US2003/0209542 adopts many microwave injection sources to microwave materials at the same time so as to increase the production. However, materials may not be uniformly heated. Consequently, the microwave processing degree of the materials is controlled by further utilizing microwave energy reflected from the materials.

Traditionally, only one microwave injection source is in a microwave chamber. A certain difficulty in achieving mass and quick production and uniform heating may occur in industrial application.

Accordingly, a multi-slot microwave device and its processing system are provided. Microwave energy injected by at least one microwave injection source is further linearized and performed with large-area by utilizing resonance mutually generated by a plurality of slot type resonant chambers, thereby effectively reducing operating time and achieving excellent microwave effect, and a purpose of uniform microwave processing can also be achieved to facilitate mass production in industries.

SUMMARY OF THE INVENTION

In view of the shortcomings of the prior art, the inventor(s) of the present invention based on years of experience in the related industry to conduct extensive researches and experiments, and finally developed a multi-slot microwave device and its processing system as a principle objective to overcome the problem of being unable to uniformly microwave materials while microwave-irradiating at large area.

To achieve the foregoing objective of the invention, a multi-slot microwave device is provided and includes a plurality of slot type microwave resonant units and at least one microwave injection source. Each plurality of slot type microwave resonant units is arranged according to an arrangement structure. Each plurality of slot type microwave resonant units independently defines a slot type resonant chamber. When the at least one microwave injection source injects microwave to the plurality of slot type microwave resonant units, the microwave is polarized at a specific direction to allow the plurality of slot type microwave resonant units to resonate to each other to generate an electromagnetic field having the same polarization direction.

An edge of the slot type resonant chamber has a lead angle. The lead angle eliminates destructive interference generated by the slot type resonant chamber to allow the plurality of slot type microwave resonant units to mutually generate constructive interference and resonance.

The slot type resonant chamber is composed of an upper resonant chamber and a lower resonant chamber, and a cross sectional area of the lower resonant chamber is smaller than a cross sectional area of the upper resonant chamber. The lead angle is disposed to the lower resonant chamber.

The slot type resonant chamber is composed of an upper resonant chamber and a lower resonant chamber, and a cross sectional area of the upper resonant chamber is smaller than a cross sectional area of the lower resonant chamber. The lead angle is disposed to the upper resonant chamber.

A bottom of the slot type resonant chamber has a protrusion structure to enhance the resonant intensity of the electromagnetic field.

The arrangement structure is to arrange the plurality of slot type microwave resonant units from one end to another end of an arrangement sequence to show periodic variation at structure.

The arrangement structure is to arrange the plurality of slot type microwave resonant units from one end to another end of an arrangement sequence to show gradually increased, gradually reduced or irregular variations of sizes.

The arrangement structure is to arrange the plurality of slot type microwave resonant units as a mirror image at a variation of a size or a shape.

The arrangement structure is one of a straight line, a ring shape or a semi-ring shape.

The arrangement structure is obliquely arranged to allow the intensity of the electromagnetic field generated by the plurality of slot type microwave resonant units to show uniform distribution above a specific axis.

The plurality of slot type microwave resonant units is obliquely arranged in order. A side of each plurality of slot type microwave resonant units has a coupling hole, and the coupling hole conducts microwave injected by at least one microwave injection source to another plurality of slot type microwave resonant units.

An interval is disposed between the adjacent plurality of slot type microwave resonant units.

A shape of the coupling hole is one of a circle, an ellipse, a square and a rectangle.

The distribution of the electromagnetic field generated by the plurality of slot type microwave resonant units is actually close to TM.sub.n10 mode, where n is a positive integer.

In addition, the invention further provides a multi-slot microwave processing system that includes at least one multi-slot microwave device and a material transportation device. The multi-slot microwave device includes a plurality of slot type microwave resonant units and the material transportation device. The material transportation device is relatively arranged with at least one multi-slot microwave device. One end of the material transportation device includes a material input port while another end of the material transportation device has a material output port corresponding to the material input port. After inputting a material to be microwaved from the material input port of the material transportation device, the material to be microwaved is directly or indirectly processed by an electromagnetic field generated by the multi-slot microwave device and outputted from the material output port of the material transportation device.

The multi-slot microwave processing system includes a plurality of multi-slot microwave devices, and the plurality of multi-slot microwave devices are arranged in parallel.

In an arrangement direction of the plurality of slot type microwave resonant units, a distance that is ½ the wavelength of a microwave is spaced between ends of the adjacent multi-slot microwave devices.

An arrangement direction of the plurality of slot type microwave resonant units and a transportation direction of the material to be microwaved are perpendicular to each other or inclined at an angle.

The multi-slot microwave device performs reciprocating motion along an arrangement direction of the plurality of slot type microwave resonant units.

A chamber wall of each slot type resonant chamber is disposed with a choke near the material input port or the material output port.

The choke is formed by cutting a portion of the chamber wall that is relatively distant from the slot type resonant chamber so that a width and a height of a cross section of a remaining portion of the chamber wall after cutting is ¼ the wavelength of a microwave.

A surface of the remaining portion after cutting is disposed with a microwave absorption material.

The microwave absorption material is selected from a group consisting of a semiconductor metal oxide, a magnetic oxide, a carbide, a carbon material, a silicide, a ferroelectric oxide and a metal micropowder.

The multi-slot microwave device and its processing system having a large-area microwave function have one or more advantages as the following:

The multi-slot microwave processing system can be expanded and is arranged with many slot type resonant devices to microwave-heat at large areas, thereby increasing the production efficiency.

The multi-slot microwave device and its processing system can generate electromagnetic fields having identical polarization by periodically arranging slot type microwave resonant units so that the problem of being unable to uniformly microwave materials can be overcome.

DETAILED DESCRIPTION OF THE PREFERRED EMBODIMENTS

The foregoing and other technical characteristics of the present invention will become apparent with the detailed description of the preferred embodiments and the illustration of the related drawings.

Figure 1:
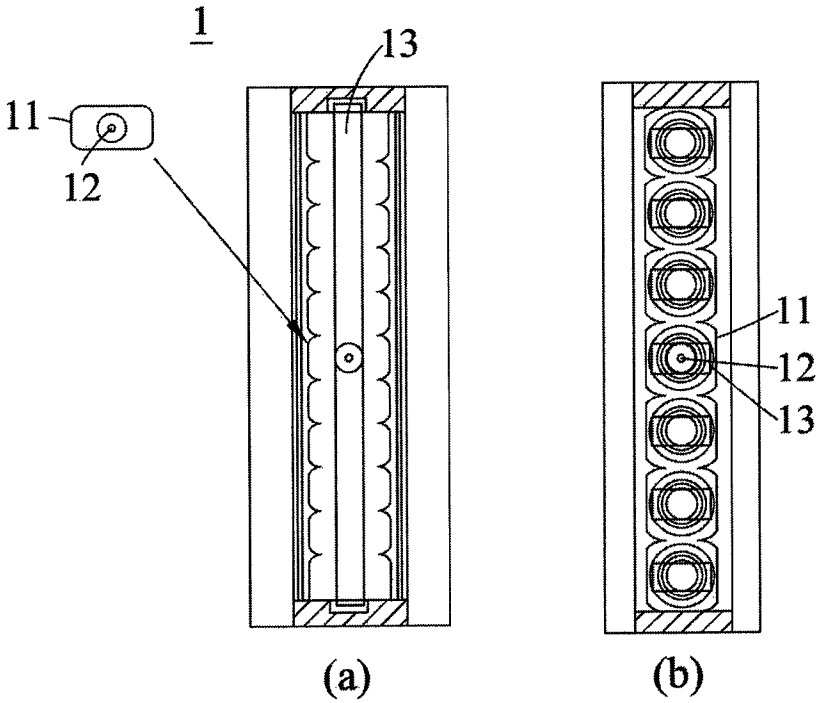
FIG. 1 is a schematic diagram of a multi-slot microwave device according to a first embodiment of the invention.

With reference to FIG. 1 for a schematic diagram of a multi-slot microwave device according to a first embodiment of the invention is depicted. In (a) figure of FIG. 1, a multi-slot microwave device 1 includes a plurality of slot type microwave resonant units 11, wherein each slot is equivalent in size to a slot type microwave resonant unit 11, and a microwave injection source 12. The slot type microwave resonant unit 11 can be disposed in an arrangement structure, and the slot type microwave resonant unit 11 can be defined as a slot type resonant chamber. The microwave injection source 12 can be a coaxial cable or a waveguide and capable of injecting microwave energy into any location of the slot type microwave resonant unit 11. Accordingly, when the microwave injection source 12 injects microwave into the slot type microwave resonant unit 11, the microwave can be polarized as a specific direction so that resonance can be generated between the slot type microwave resonant units 11, and an electromagnetic field having the same polarization direction is formed to generate heat by affecting with a heating auxiliary material 13. Alternatively, the field can directly heat a material or perform other processes (as shown in FIG. 1(*b*)).

Figure 2:
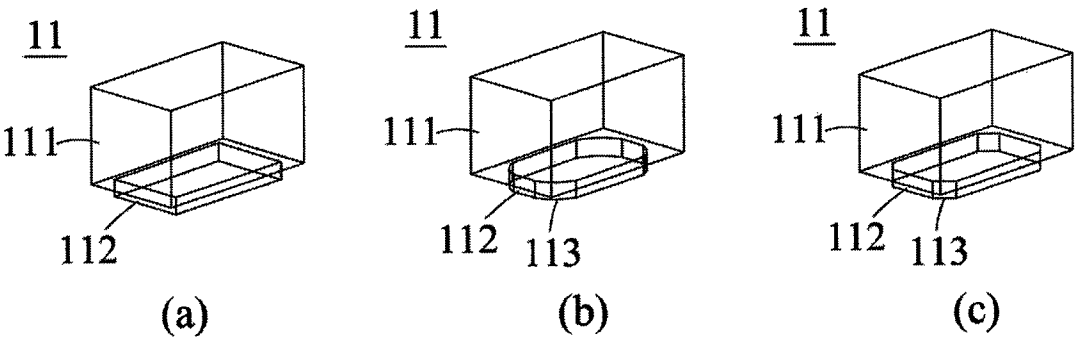
FIG. 2 is a schematic diagram of a multi-slot microwave device according to a second embodiment of the invention.

To further depict the first embodiment, with reference to FIG. 2 for a schematic diagram of a basic slot type resonant chamber according to the invention is depicted. The slot type microwave resonant chamber 11 is a slot type resonant chamber. Each single slot type resonant chamber can be divided into an upper resonant chamber 111 and a lower resonant chamber 112. The cross sectional area and the structure of the upper resonant chamber 111 and the lower resonant chamber 112 are classified into different types. For example, the lower resonant chamber 112 of the basic slot type resonant can be a rectangle (FIG. 2(*a*)), an ellipse-like (FIG. 2(*b*)) or a polygon (FIG. 2(*c*)). The cross sectional area of the upper resonant chamber 111 of the basic slot type resonant chamber is greater than the cross sectional area of the lower resonant chamber 112. A lead angle 113 can be disposed at an edge of the lower resonant chamber 112. When microwave injection source 12 injects microwave, the design of the lead angle 113 can eliminate the destructive interference generated by the slot type resonant chamber structure to further generate constructive interference and resonance between slot type microwave resonant units 11.

Figure 3:
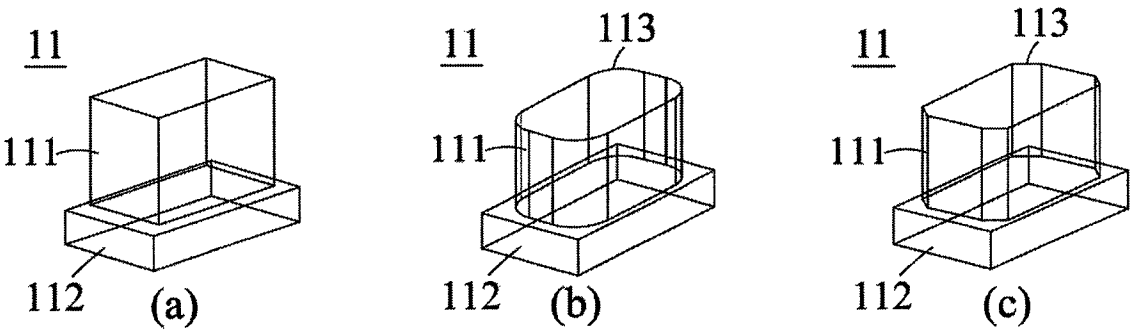
FIG. 3 is a schematic diagram of a basic slot type resonant chamber according to the invention.

Further, with reference to FIG. 3 for a schematic diagram of an inversive slot type resonant chamber according to the invention is depicted. The upper resonant chamber 111 of the inversive slot type resonant chamber can be a rectangle (FIG. 3(*a*)), an ellipse-like (FIG. 3(*b*)) or a polygon (FIG. 3(*c*)). The cross sectional area of the upper resonant chamber 111 of the inversive slot type resonant chamber is smaller than the cross sectional area of the lower resonant chamber 112. A lead angle 113 can be disposed at any edge of the upper resonant chamber 111. When the microwave injection source 12 injects microwave, the design of the lead angle 113 can eliminate the destructive interference generated by the slot type resonant chamber structure to further generate the constructive interference and resonance between the slot type microwave resonant units 11.

Figure 4:
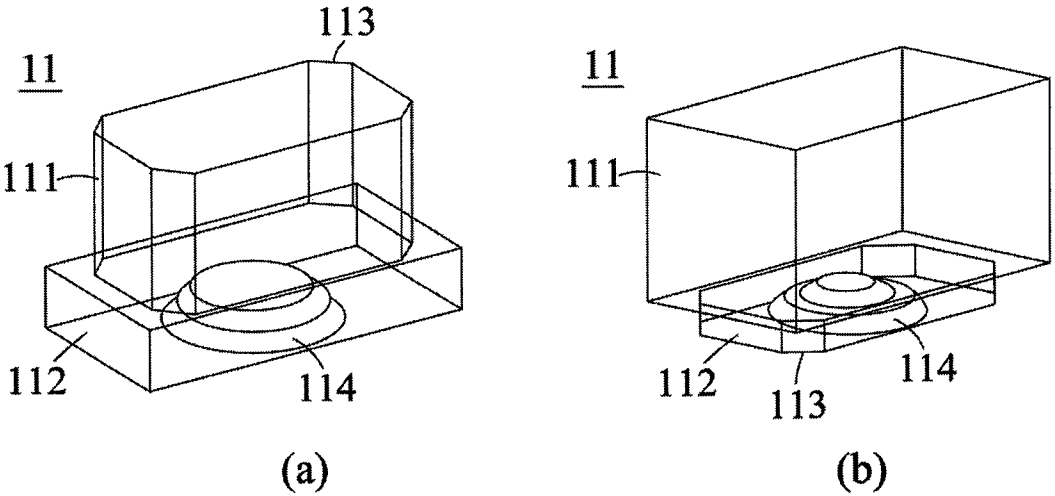
FIG. 4 is a schematic diagram of an inversive slot type resonant chamber according to the invention.

Another slot type resonant chamber is a protruded slot type resonant chamber. With reference to FIG. 4 for a schematic diagram of a protruded slot type resonant chamber according to the invention is depicted. The cross sectional area of the upper resonant chamber 111 of the protruded slot type resonant chamber can be greater than the cross sectional area (FIG. 4(*b*)) of the lower resonant chamber 112. The cross sectional area of the upper resonant chamber 111 can be smaller than the cross sectional area (FIG. 4(*a*)) of the lower resonant chamber 112. However, it should be noted that a protrusion structure 114 can be disposed at a bottom of the lower resonant chamber 112 of the protruded slot type resonant chamber to increase the intensity of the electromagnetic field in the slot type resonant chamber.

Figure 5:
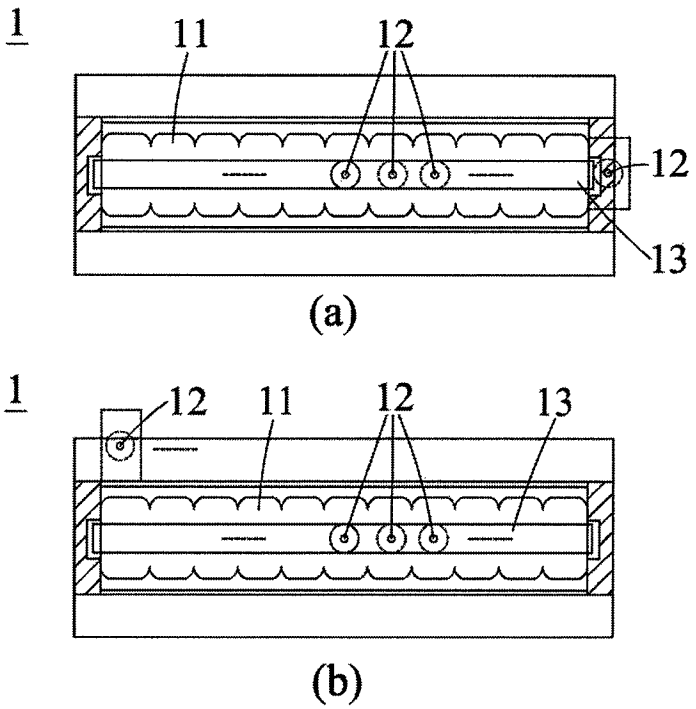
FIG. 5 is a schematic diagram of a protruded slot type resonant chamber according to the invention.

With reference to FIG. 5 for a schematic diagram of a multi-slot type microwave device according to a second embodiment of the invention is depicted. The multi-slot microwave device 1 includes a plurality of slot type microwave resonant units 11 and a plurality of microwave injection sources 12. The multi-slot microwave resonant device 1 can have many microwave injection sources 12, and the disposition location of the microwave injection source 12 can be randomly arranged. As long as microwave can enter the slot type resonant chamber of the slot type microwave resonant unit 11. The slot type microwave resonant unit 11 has been depicted in the foregoing embodiment, and there is no need to describe herein. The microwave injection source 12 can be a coaxial cable or a waveguide and can inject microwave in the slot type microwave resonant unit 11. When the microwave injection source 12 injects microwave in the slot type microwave resonant unit 11, a resonance can be generated between the slot type microwave resonant units 11, and an electromagnetic field having the same polarization direction is formed to generate heat by affecting with a heating auxiliary material 13 or can directly heat a material or perform other processes. For example, in FIG. 5(*a*), the microwave injection source 12 can be disposed at two ends of the multi-slot microwave device 1. In addition, as shown in FIG. 5(*b*), the microwave injection source 12 can be disposed at two sides of the multi-slot microwave device 1.

Figure 6A:
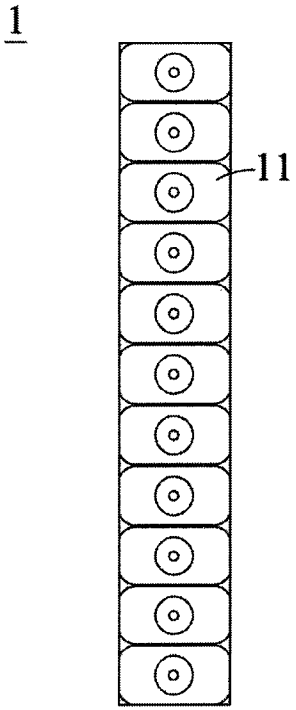
FIG. 6A is a first schematic diagram of a multi-slot microwave device according to a third embodiment of the invention.
Figure 6B:
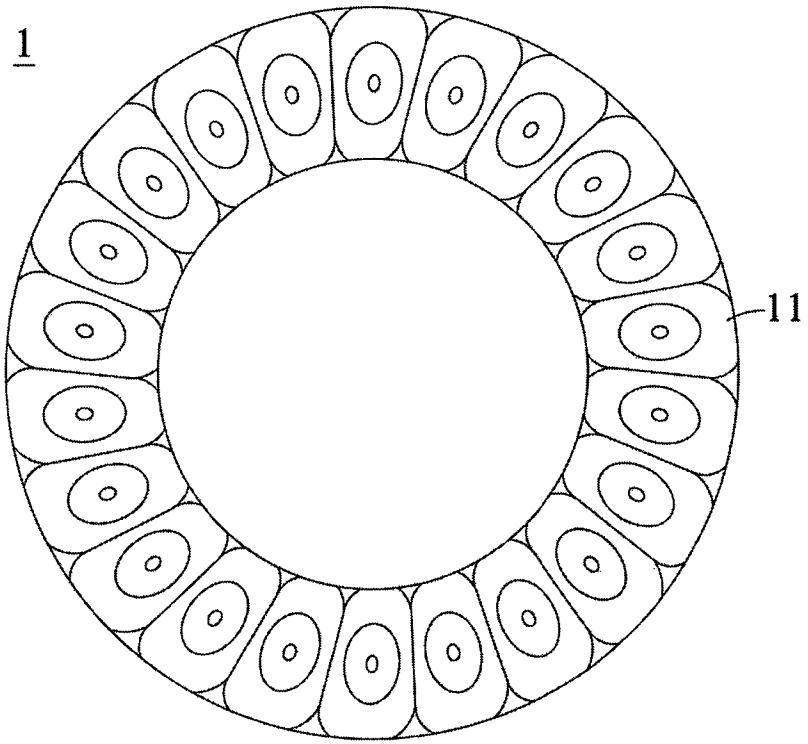
FIG. 6B is a second schematic diagram of a multi-slot microwave device according to a third embodiment of the invention.
Figure 6C:
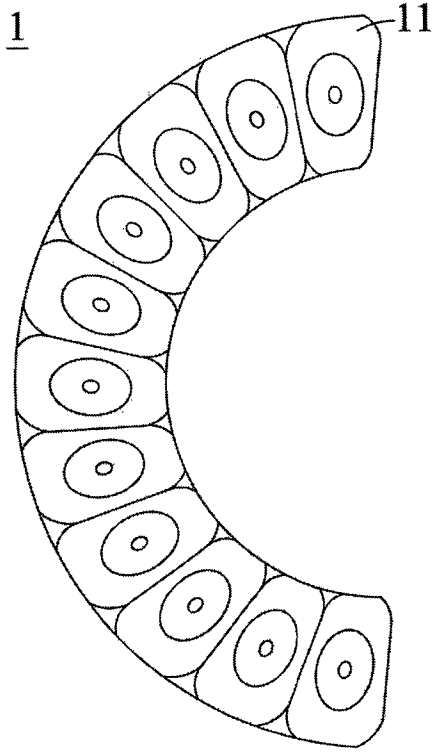
FIG. 6C is a third schematic diagram of a multi-slot microwave device according to a third embodiment of the invention.

With reference to FIG. 6A, FIG. 6B and FIG. 6C for schematic diagrams of a multi-slot microwave device according to a third embodiment of the invention are depicted. In the embodiment, a plurality of slot type microwave resonant units 11 can be arranged as an array structure. For example, the slot type microwave resonant units 11 can be arranged as the array structure (as shown in FIG. 6A) in a straight line. The slot type microwave resonant unit 11 can closely lean against to each other or can be spaced at an interval. On the other hand, the array structure of another slot type microwave resonant unit 11 can be arranged as a ring structure (as shown in FIG. 6B), and the ring structure can also be an ellipse structure. Moreover, input/output ports for materials to be microwaved can be disposed at any location of the ring of the slot type microwave resonant unit 11 and collocated with a ring transportation device to microwave and heat materials. Further, an array structure of a slot type microwave resonant units 11 can be arranged as a semi-ring structure (as shown in FIG. 6C). The semi-ring structure can also be a semi-ellipse structure, and arc of the semi-ring can be between 0 and 360 degrees. Furthermore, the input/output ports for materials to be microwaved can be disposed at two ends of the multi-slot microwave device 1 and collocated with a semi-ring transportation device to microwave and heat materials.

The arrangement sequence of the slot type microwave resonant unit 11 is from one end to another and can be periodically varied at the structure. Since the arrangement sequence of the slot type microwave resonant unit 11 from one end to another can be variations of gradually increased, gradually reduced or irregular sizes. Alternatively, the plurality of slot type microwave resonant units 11 can be arranged as a mirror image at the variations of sizes or shapes. In other words, to satisfy application demands, the slot type microwave resonant units 11 with different structure sizes can be sequentially arranged at the arrangement structure.

Figure 7:
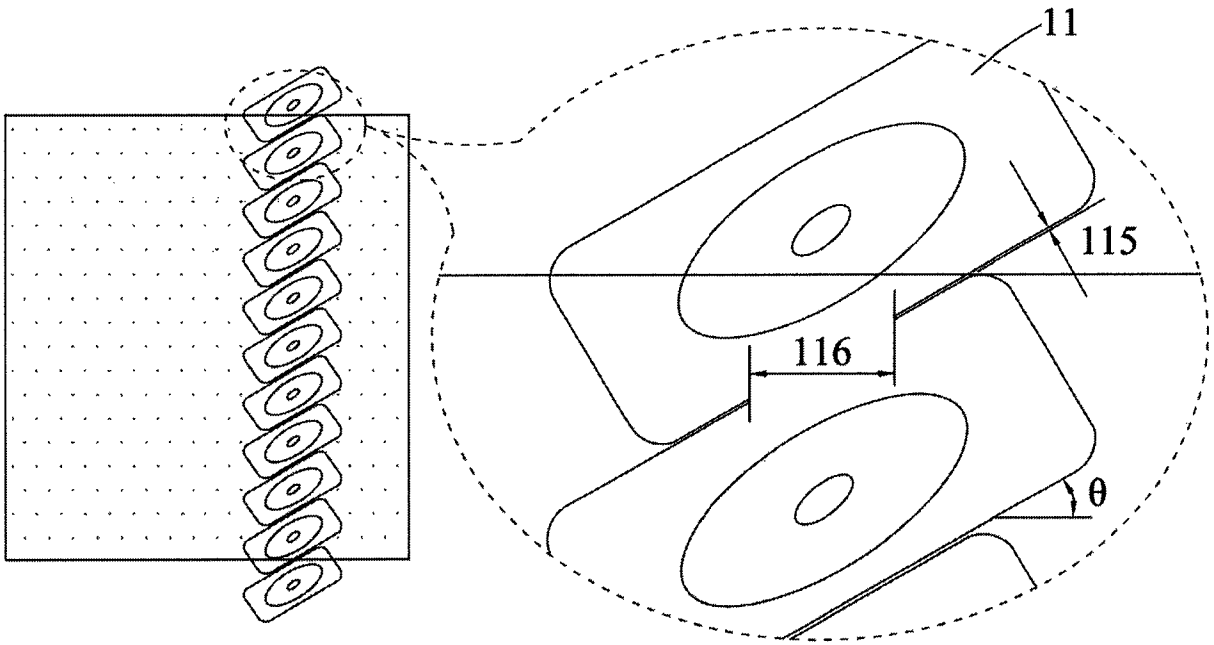
FIG. 7 is a schematic diagram of a multi-slot microwave device according to a fourth embodiment of the invention.

With reference to FIG. 7 for a schematic diagram of a multi-slot microwave device according to a fourth embodiment of the invention is depicted. To uniformly distribute electromagnetic field intensity generated by each plurality of slot type microwave resonant units 11 at specific axes, the plurality of slot type microwave resonant units 11 can be sequentially arranged in an inclination, wherein its inclined angle is θ. An interval 115 is between adjacent slot type microwave resonant units 11. A side or two sides of the slot type microwave resonant unit 11 can have coupling holes 116, and the coupling hole 116 can conduct microwave injected by the microwave injection source 12 to another slot type microwave resonant unit 11. It should be noted that the area of the coupling hole 116 of the multi-slot microwave device 1 of the invention can be regulated according to the injected microwave frequencies to generate resonance between the slot type microwave resonant units 11. The shape of the coupling hole 116 can be any geometrical shape such as a circle, an ellipse, a square or a rectangle.

In addition, the distribution of the electromagnetic field generated by the multi-slot microwave device 1 is similar to TM.sub.n10 mode (n is positive integer). In other words, in actual application, the multi-slot microwave device 1 can be disposed with input/output ports, auxiliary heating materials, periodic structures and thermal isolators and the like. Therefore, TM.sub.n10 mode will be cracked and distorted to generate non-z directional polarization. However, major parts are still similar to the feature of TM.sub.n10 mode. In other words, the polarization direction of the electromagnetic field of the multi-slot microwave device is predominately in a z direction.

Figure 8:
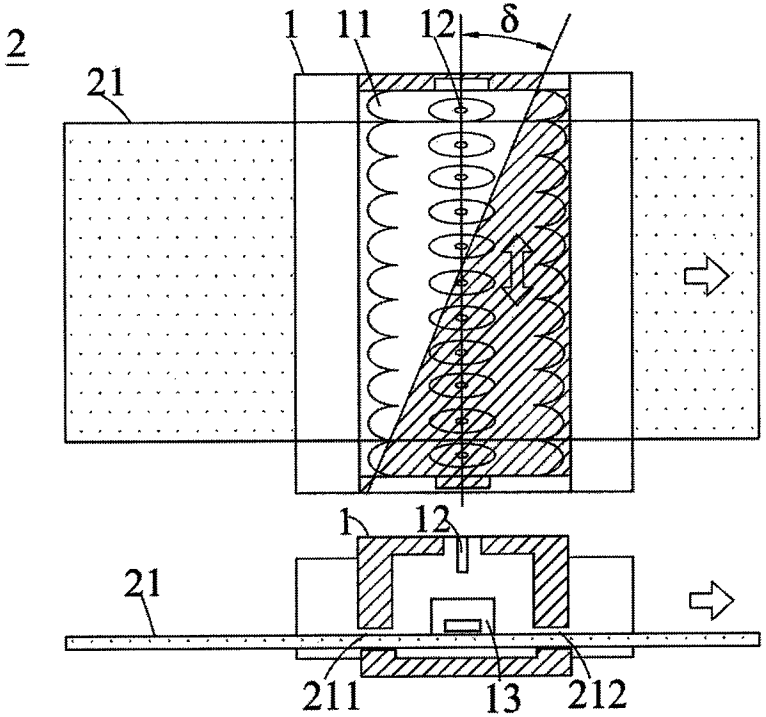
FIG. 8 is a first schematic diagram of a multi-slot microwave processing system according to a first embodiment of the invention.

FIG. 8 is a schematic diagram of a multi-slot microwave processing system according to a first embodiment of the invention. The multi-slot microwave processing system 2 includes a multi-slot microwave device 1 and a material transportation device 21. The multi-slot microwave device 1 includes a plurality of slot type microwave resonant units 11, and the plurality of slot type microwave resonant units 11 can be arranged in order. The material transportation device 21 is relatively allocated with the multi-slot microwave device 1 to irradiate microwave generated by the multi-slot microwave device 1 on the material transportation device 21, wherein one end of the material transportation device 21 includes a material input port 211 while another end corresponding to the material input port 211 includes a material output port 212. After a material that has been processed with microwave is inputted by the material input port 211 of the material transportation device 21, the material is directly or indirectly processed by the electromagnetic field generated from the multi-slot microwave device 1 and is outputted by the material output port 212 of the material transportation device 21. In an arrangement direction of a plurality of slot type microwave resonant units 11, at least one multi-slot microwave device 1 and a transportation direction of the material are perpendicular to each other or inclined at an angle δ.

The multi-slot microwave processing system 2 can directly irradiate microwave on the material based upon microwave absorption capability of the material. Alternatively, properly using microwave auxiliary absorption materials can support the material to absorb microwave energy. The microwave auxiliary absorption material can be selected from one of a semiconductor metal oxide, a magnetic oxide, a carbide, a carbon material, a silicide, a ferroelectric oxide, a metal micropowder or any of the foregoing combination.

It should be noted that the material output port 212 or the material input port 211 of the material transportation device 21 can be disposed with a closing device. The closing device of the multi-slot microwave processing system 2 may not leak microwave energy during the operation of microwave.

Figure 9:
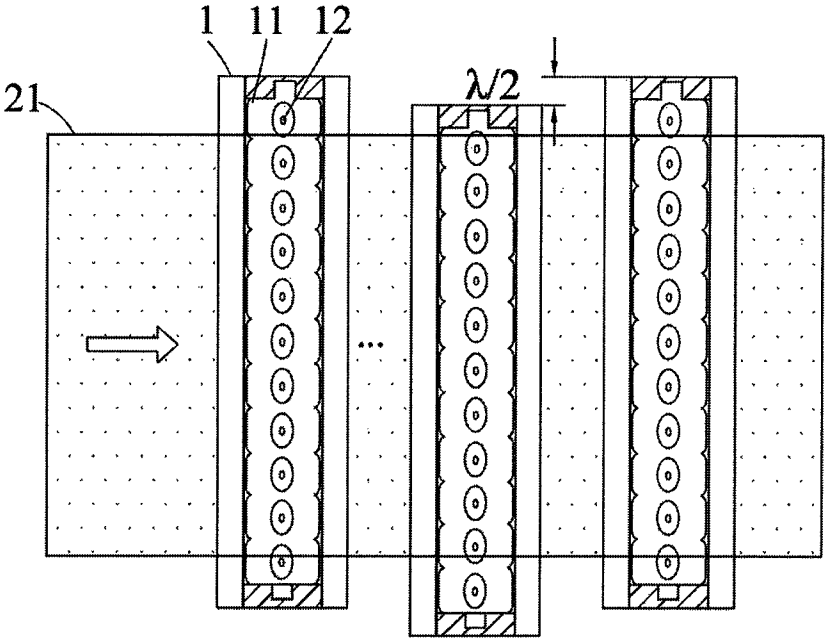
FIG. 9 is a schematic diagram of a multi-slot microwave processing system according to another embodiment of the invention.

With reference to FIG. 9 for a schematic diagram of a multi-slot microwave processing system according to another embodiment of the invention is depicted. Many multi-slot microwave devices 1 can be arranged in parallel. The arrangement direction of the slot type microwave resonant unit 11 in the multi-slot microwave device 1 and the material transportation direction can be perpendicular to each other or be inclined at an angle, and in an arrangement direction of the slot type microwave resonant unit, a distance that is ½ the wavelength of a microwave is spaced between ends of the adjacent multi-slot microwave devices 1. Alternatively, the multi-slot microwave device can perform reciprocating motion along a direction that is vertical to the direction of the material transportation. Accordingly, the multi-slot microwave processing system of the invention can microwave-heat large areas of the material at the same time and increase heated uniformity.

Figure 10:
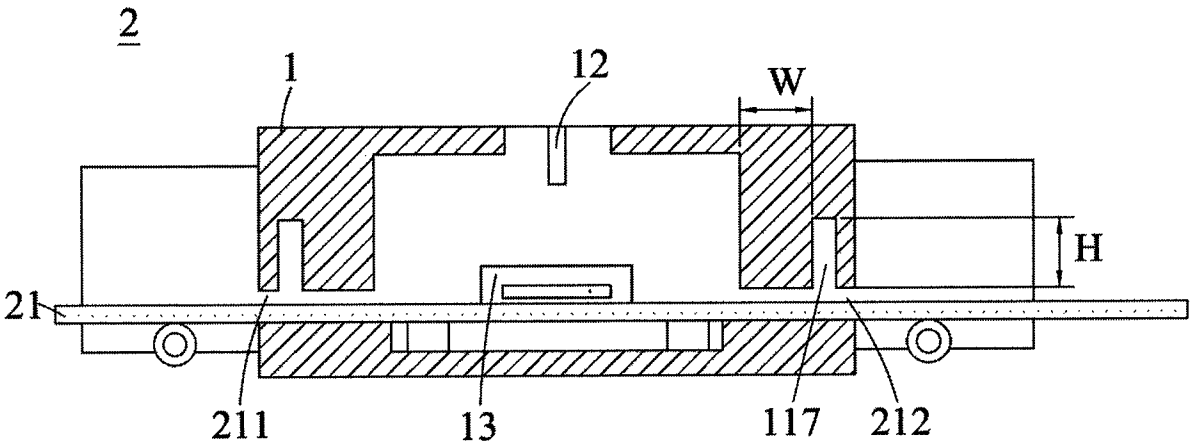
FIG. 10 is a cross-sectional drawing of a multi-slot microwave processing system according to a first embodiment and a second embodiment of the invention.

With reference to FIG. 10 for a cross-sectional drawing of a multi-slot microwave processing system according to a first embodiment and a second embodiment of the invention is depicted. A chamber wall of each slot type resonant chamber can be disposed with a choke 117 near the material input port 211 or the material output port 212. The choke 117 is formed by cutting a portion of the chamber wall that is relatively distant from the slot type resonant chamber so that the width W and the height H of the cross section is ¼ the wavelength of a microwave to effectively prevent microwave generated by each multi-slot microwave device 1 from interfering with each other.

Figure 11:
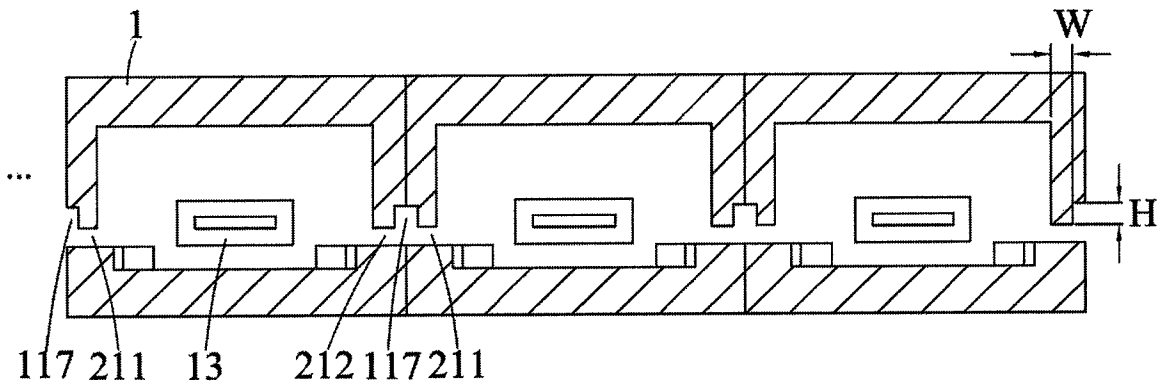
FIG. 11 is a schematic diagram of a multi-slot microwave processing system according to a third embodiment of the invention.

With reference to FIG. 11 for a schematic diagram of a multi-slot microwave processing system according to a third embodiment of the invention is depicted. Several multi-slot microwave processing devices 1 are arranged side by side, and a choke can be disposed at the material input port 211 or the material output port 212 to allow adjacent chokes 117 of the multi-slot microwave devices 1 to connect to each other. The choke 117 is depicted in the foregoing embodiment and there is no need to describe herein.

It should be noted that surfaces of the remaining portions can be disposed with microwave absorption materials. The microwave absorption material can mainly be one of a semiconductor metal oxide, a magnetic oxide, a carbide, a carbon material, a silicide, a ferroelectric oxide, a metal micropowder or any of the foregoing combination. Therefore, it can effectively prevent the microwave generated by each multi-slot microwave device 1 from interfering with each other.

The multi-slot microwave device and its processing system of the invention have identical polarized electromagnetic field to uniformly microwave materials. Accordingly, in the multi-slot microwave processing system, multiple multi-slot microwave devices can be expanded and arranged side by side to perform large-area microwave heating, thereby enhancing production efficiency and reducing production costs, and the quality of microwaved materials can be increased.

The invention improves over the prior art and complies with patent application requirements, and thus is duly filed for patent application. While the invention has been described by device of specific embodiments, numerous modifications and variations could be made thereto by those generally skilled in the art without departing from the scope and spirit of the invention set forth in the claims.

What is claimed is:

1. A multi-slot microwave device comprising:

a plurality of slot type microwave resonant units arranged and disposed according to an arrangement structure, each plurality of slot type microwave resonant units independently defining a slot type resonant chamber; and at least one microwave injection source for injecting a microwave to the plurality of slot type microwave resonant units, the microwave polarized at a specific direction to allow the plurality of slot type microwave resonant units to resonate to each other, thereby generating an electromagnetic field having identical polarization directions, wherein a chamber wall of each slot type resonant chamber is disposed with a choke, and wherein the choke is formed by cutting a portion of the chamber wall that is relatively distant from the slot type resonant chamber so that a width and a height of a cross section of a remaining portion of the chamber wall after cutting is a ¼ the wavelength of the microwave.

2. The multi-slot microwave device as recited in claim 1, wherein an edge of the slot type resonant chamber has a lead angle, and the lead angle eliminates destructive interference generated by the slot type resonant chamber to allow the plurality of slot type microwave resonant units to mutually generate constructive interference and resonance.

3. The multi-slot microwave device as recited in claim 2, wherein the slot type resonant chamber is composed of an upper resonant chamber and a lower resonant chamber, and a cross sectional area of the lower resonant chamber is smaller than a cross sectional area of the upper resonant chamber, and the lead angle is disposed to the lower resonant chamber.

4. The multi-slot microwave device as recited in claim 2, wherein the slot type resonant chamber is composed of an upper resonant chamber and a lower resonant chamber, and a cross sectional area of the upper resonant chamber is smaller than a cross sectional area of the lower resonant chamber, and the lead angle is disposed to the upper resonant chamber.

5. The multi-slot microwave device as recited in claim 1, wherein a bottom of the slot type resonant chamber is a protrusion structure to enhance resonant intensity of the electromagnetic field.

6. The multi-slot microwave device as recited in claim 1, wherein the arrangement structure is to arrange the plurality of slot type microwave resonant units from one end to another end of an arrangement sequence to show periodic variation at structure.

7. The multi-slot microwave device as recited in claim 1, wherein the arrangement structure is to arrange the plurality of slot type microwave resonant units from one end to another end of an arrangement sequence to show gradually increased, gradually reduced or irregular variations of sizes.

8. The multi-slot microwave device as recited in claim 1, wherein the arrangement structure is to arrange the plurality of slot type microwave resonant units as a mirror image of variations of size or shape.

9. The multi-slot microwave device as recited in claim 1, wherein the arrangement structure is a straight line, a ring shape or a semi-ring shape.

10. The multi-slot microwave device as recited in claim 1, wherein the arrangement structure is obliquely arranged to uniformly distribute intensity of the electromagnetic field generated by the plurality of slot type microwave resonant units above a specific axis.

11. The multi-slot microwave device as recited in claim 1, wherein a side of the plurality of slot type microwave resonant units has a coupling hole, and the coupling hole conducts the microwave injected by at least one microwave injection source to another plurality of slot type microwave resonant units.

12. The multi-slot microwave device as recited in claim 11, wherein an interval is disposed between adjacent pluralities of slot type microwave resonant units.

13. The multi-slot microwave device as recited in claim 12, wherein a shape of the coupling hole is one of a circle, an ellipse, a square or a rectangle.

14. The multi-slot microwave device as recited in claim 1, wherein a distribution of the electromagnetic field generated by the plurality of slot type microwave resonant units is actually similar to TM.sub.n10 mode, where n is a positive integer.

15. A multi-slot microwave processing system comprising:

at least one multi-slot microwave device as recited in claim 1 and comprising a plurality of slot type microwave resonant units; and a material transportation device relatively disposed with the at least one multi-slot microwave device, one end of the material transportation device including a material input port while another end of the material transportation device having a material output port corresponding to the material input port, after inputting a material to be microwaved from the material input port of the material transportation device, the material to be microwaved directly or indirectly is processed by an electromagnetic field generated by the at least one multi-slot microwave device and outputted from the material output port of the material transportation device.

16. The multi-slot microwave processing system as recited in claim 15, further comprising the plurality of multi-slot microwave devices, the plurality of multi-slot microwave devices are arranged in parallel.

17. The multi-slot microwave processing system as recited in claim 16, wherein an arrangement direction of the plurality of slot type microwave resonant units, a distance that is ½ the wavelength of a microwave is spaced between ends of the adjacent multi-slot microwave devices.

18. The multi-slot microwave processing system as recited in claim 15, wherein an arrangement direction of the plurality of slot type microwave resonant units and a transportation direction of the material to be microwaved are perpendicular to each other or inclined at an angle.

19. The multi-slot microwave processing system as recited in claim 15, wherein the multi-slot microwave device performs reciprocating motion along an arrangement direction of the plurality of slot type microwave resonant units.

20. The multi-slot microwave processing system as recited in claim 15, wherein the chamber wall of each slot type resonant chamber is disposed with the choke near the material input port or the material output port.

21. The multi-slot microwave processing system as recited in claim 20, wherein a surface of the remaining portion after cutting is disposed with a microwave absorption material.

22. The multi-slot microwave processing system as recited in claim 21, wherein the microwave absorption material is selected from a group consisting of a semiconductor metal oxide, a magnetic oxide, a carbide, a carbon material, a silicide, a ferroelectric oxide and a metal micropowder.

* * * * *